United States Patent [19]

Schneider

[11] Patent Number: 4,955,723

[45] Date of Patent: Sep. 11, 1990

[54] SLURRY MIXING APPARATUS WITH DRY POWDER CONVEYER

[76] Inventor: John R. Schneider, 26 Cove Rd., Belvedere, Calif. 94920

[21] Appl. No.: 465,432

[22] Filed: Jan. 16, 1990

[51] Int. Cl.[5] ..... B01F 15/02

[52] U.S. Cl. ..... 366/136; 366/139; 366/153

[58] Field of Search ..... 366/136, 137, 139, 151, 366/153, 159, 167, 168

[56] References Cited

U.S. PATENT DOCUMENTS

| | | | |
|---|---|---|---|
| 3,969,314 | 7/1976 | Grigull | 366/139 |
| 4,045,004 | 8/1977 | Berger | 366/159 |
| 4,444,508 | 4/1984 | Kreuer | 366/139 |
| 4,486,100 | 12/1984 | Endo | 366/139 |

*Primary Examiner*—Robert W. Jenkins
*Attorney, Agent, or Firm*—Owen, Wickersham & Erickson

[57] ABSTRACT

An apparatus for combining powered and liquid constituents to form a slurry, comprises a first tank for initially holding a quantity of liquid and a second tank having an upper and a lower end. A first conduit has a valve extending from the first tank to the second tank. A control means responsive to the liquid level in the second tank closes the valve when the liquid in the second tank reaches a predetermined maximum level. This maximum level is substantially lower than the full volumetric capacity of the second tank so that an open chamber is formed above the maximum liquid level. A vacuum pump attached to the upper end of said second tank creates a reduced pressure in its open chamber. A chamber conveying conduit extending through the upper end of the second tank has a movable exterior section with an outer end opening and a fixed interior section within the second tank having an outlet extending slightly above the maximum liquid level so that a low pressure condition is created within the open chamber above the maximum liquid level and causes an airstream in the conveying conduit which enables powdered material to be sucked into the second tank as mixing occurs with liquid therein to form a slurry.

5 Claims, 1 Drawing Sheet

SLURRY MIXING APPARATUS WITH DRY POWDER CONVEYER

This invention relates to an improved apparatus for conveying and mixing powder materials into to form a slurry.

BACKGROUND OF THE INVENTION

In the preparation of various slurry mixtures used for different industrial applications, a volume of dry powder must be placed in a mixing apparatus where it can be combined with the proper type and amount of liquid to form the slurry. For many situations it is necessary for a relatively high volume of dry powder to be supplied to a mixing chamber containing liquid within a relatively short period of time. Often, the dry powder is a material that is toxic or in some way hazardous to a person's health if breathed in. In some situations this necessity to handle a large quantity of powder created a serious problem due to the possibility of releasing even small amounts of the powder into the surrounding atmosphere where they could be ingested by workers. For example, in the preparation of so-called body-feed slurry for industrial filter systems, it is necessary to introduce a large volume of diatomaceous earth to a mixing chamber containing a liquid coolant. Heretofore, the powdered diatomaceous earth material was typically supplied in 50 pound sacks which were manually opened and dumped into a mixer to form a slurry. Aside from the fact that such manual dumping created dust laden air that was dangerous to breathe, it was overly labor intensive and also too slow in many instances.

Accordingly, a general object of the present invention is to provide a slurry mixing apparatus with a dry powder conveying system that eliminates the possibility of releasing even small amounts of dry powder into the atmosphere; that speeds up the process of conveying the dry powder into a mixing chamber; that reduces the amount of manual labor required to supply the dry powder to a liquid and that provides a means for controlling the rate of flow of powdered material to the mixing chamber.

Yet another object of the invention is to provide a two tank mixing system for combining a dry powder with a liquid to form a slurry of a predetermined concentration with a uniform consistency.

Another object of the invention is to provide an improved mixing chamber wherein a reduced pressure can be maintained to draw in powdered material while the mixing process takes place.

SUMMARY OF THE INVENTION

In accordance with principles of the invention, a two tank mixing system is provided. A first and larger tank which is sized to hold a full batch of fully mixed slurry product is provided. This first tank is connected to a preliminary mixing chamber provided with a motor driven agitator for blending a dry powdered material with a liquid to form a slurry. Near the upper end of the mixing chamber is an outlet that is connected to a vacuum pump which removes air from the chamber and thus maintains a reduced pressure within the chamber. A second outlet connected to the bottom end of the chamber is connected to another pump for removing slurry after it is thoroughly mixed and conveying it to the first tank. A conduit from the first supply tank furnishes liquid to the mixing chamber through a controllable valve. A slurry level control is provided within the chamber to maintain the mixed slurry at a predetermined level. This control is connected to the liquid supply conduit to provide a means for controlling the slurry level in the chamber. Extending within the chamber is an inner section of a dry powder conveying conduit whose outlet end is located just above the level of slurry that is maintained within the chamber. Outside the chamber the powder conduit has a flexible suction hose section with a valve at its outer end. Since the vacuum pump creates a reduced pressure within the chamber, there is a constant flow of air through the suction hose. Thus, a worker can easily maneuver the hose to place its outer end within sacks of material to convey the material quickly into the chamber without requiring any manual lifting and without contaminating the atmosphere outside the chamber with powder particles.

Other objects, advantages and features of the invention will become apparent from the following detailed description of one embodiment thereof, presented in conjunction with the accompanying drawing. Within the smaller tank the powdered material is combined with liquid which flows from the larger tank until all of the slurry is formed and ultimately moved to the larger tank for storage. Thereafter, the slurry mixture in the larger tank, having a predetermined powder to liquid proportion, can be metered out for use, such as for a body feed mixture for a filter.

DETAILED DESCRIPTION OF EMBODIMENT

Figure 1:
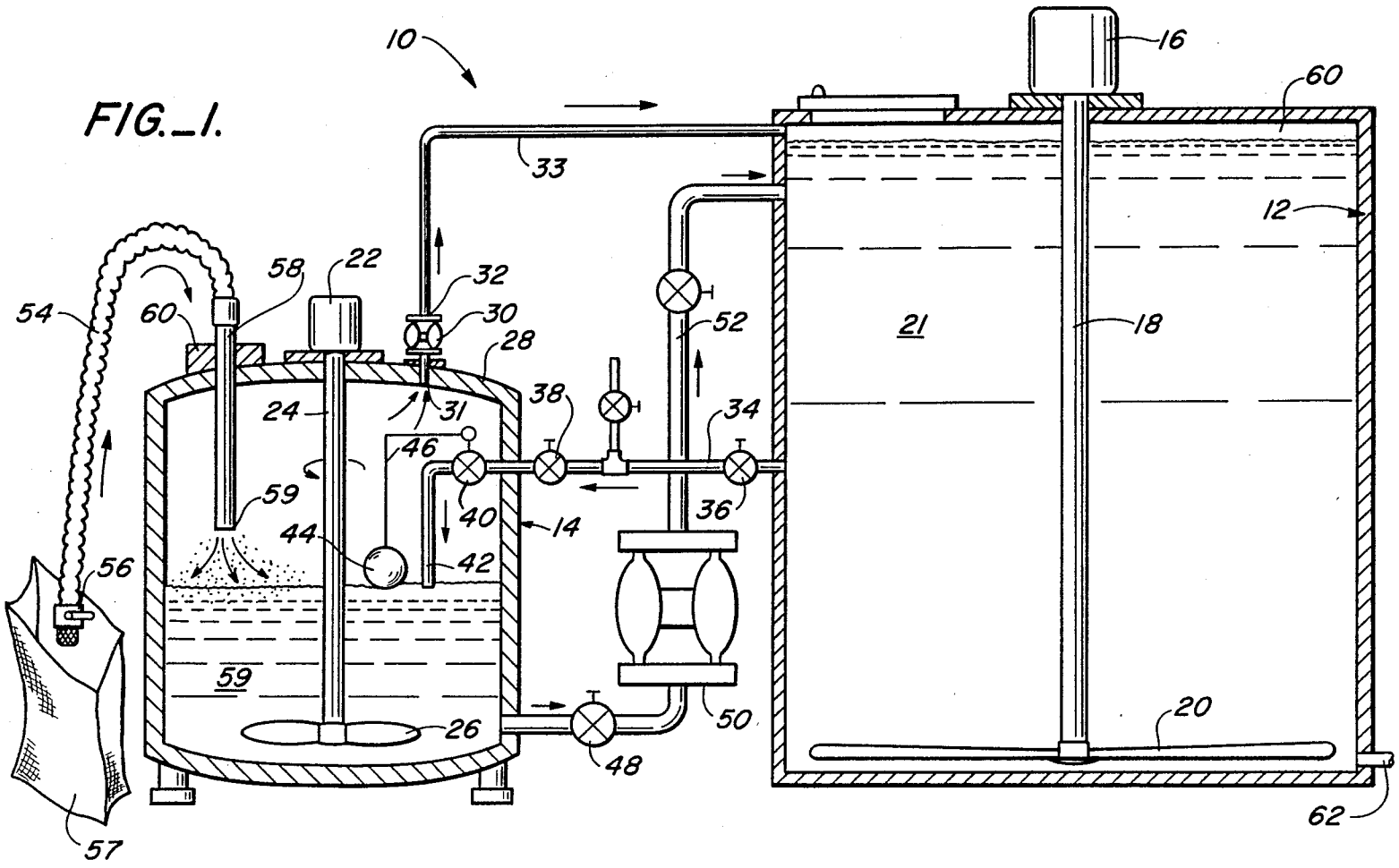
FIG. 1 is a diagrammatic view in elevation and in section showing a slurry mixing chamber embodying principles of the present invention.

With reference to the drawing, FIG. 1 shows a mixing system 10 embodying principles of the present invention for forming a slurry from quantities of a liquid and a powdered material. The system is particularly adaptable for providing a body feed mixture for use in industrial filters comprised of a liquid coolant and powdered material such as diatomaceous earth. The mixing system 10, as shown, is comprised of a main body feed tank 12 and an auxiliary mixing tank 14 which are connected together.

The purpose of the first tank 12 which is cylindrical in shape is to retain one entire batch of mixed material with predetermined proportions of liquid and powder. An electric motor 16 mounted on the upper end of the tank drives a shaft 18 that is connected to a circular agitator 20 at its lower end near the bottom of tank 12. Before the mixing process for a batch commences, the tank 12 is filled with a liquid 21 (such as an oil coolant) to a preselected level near the top end of the tank.

The second tank 14, which is considerably smaller than tank 12, provides a vessel within which the major mixing of liquid and powder is accomplished. Tank 12 is also cylindrical in shape and has a motor 22 at its upper end which is connected by a shaft 24 to a rotatable agitator 26 at its lower end within the tank. The agitator has a plurality of blades which stir and mix the material as it is supplied. Mounted on the upper end 28 of the tank 14 is a vacuum pump 30 of any suitable type that is commercially available. The input 31 to this pump is exposed to the upper end interior of the tank 14 so that it will remove air from and tend to create a vacuum within tank 14. The outlet 32 from vacuum 30 is connected by a conduit 33 to the upper end of tank 12. Thus, air drawn from tank 14 by the vacuum pump is forced into the upper end of tank 12 to help force liquid out of tank 12. A conduit 34 extends from the side of tank 12 through a pair of valves 36 and 38 and into tank 14. Within the latter tank, the conduit is connected through a shutoff valve 40 to a downwardly directed outlet pipe 42. A float 44 within the tank 14 is connected by a conventional lever arm attachment 46 to the valve 40 and functions to close valve 40 when the liquid reaches a predetermined level within the tank 14.

At the bottom of tank 14 is an outlet valve 48 connected to a pump 50 which draws mixed slurry from tank 14 and pushes it through an outlet conduit 52 to a point near the upper end of tank 12. Thus, the slurry mixed in tank 14 is supplied directly to the liquid in tank 12.

Dry powder for the slurry being mixed is normally provided in 50 or 100 pound sacks. In accordance with the invention, a flexible conduit 54 having a controllable nozzle 56 is attached to an inlet pipe 58 extending downwardly through a fitting 60 fixed to the upper end of the mixing tank 14. The end 59 of the pipe 58 within the tank 14 is positioned just above the maximum liquid level obtainable within the tank 14 as controlled by the float-valve 40. The vacuum or low pressure created within the tank 14 by the vacuum pump 30 causes a constant air-flow through the flexible conduit 54. Thus, to transfer powder into the mixing tank 14, a worker merely manipulates the flexible conduit by placing its outer nozzle end 56 into a sack 57 of powdered material, causing the material to be entrained in the air through the conduit 54 and through pipe 58 into the mixing tank 14. During this transfer procedure no harmful powder can escape to the atmosphere and thus be breathed in by workers in the area. Since the lower end 59 of the rigid conduit 58 within the tank 14 is located just above the slurry mix (e.g. four to six inches) and is remote from the vacuum pump inlet at the top end of the tank, the powder passing through it is immediately mixed into the slurry.

In the operation of the mixing system, such as for body feed used in an industrial filter, the supply tank 12 is first filled with liquid 21, such as an oil based coolant. Generally, the liquid level is somewhat below the upper end of tank 12 so that an air space 60 is provided. When the valves 36 and 38 are opened, the liquid coolant will flow into tank 14 until the float 44 rises to a preset level, at which point it closes the internal valve 40. With the vacuum pump 30 on tank 14 turned on, the pressure in tank 14 is reduced, causing a suction on the flexible conduit 54. The flexible conduit, as previously described, can now be manipulated by inserting its outer end 56 into a sack 57 of powdered material, causing the material to flow into tank 14 and into the liquid therein. With the agitator 26 in tank 14 "on", the powder and liquid quickly mix to form a slurry 59. When a substantial amount of slurry has been formed, the pump 50 may be activated to move the slurry into tank 12. With the agitator 20 of tank 12 also turned on, the slurry admitted to tank 12 is readily dispersed. Now, liquid from tank 12 is continuously supplied to tank 14 as fast as mixed slurry is removed therefrom and cycled back to tank 12. After all of the powdered material required for the amount of liquid coolant furnished has been sucked into tank 14, and has been combined therein with liquid to form a slurry, and when all this slurry has been transferred to the main tank 12, the batch of combined liquid and powder has been mixed and blended together in the desired preselected proportions. Thereafter, the mixed powder and liquid or body feed material can be pumped from an outlet 62 in tank 12 at the desired rate into a filter or to some other location where it is to be utilized. Thus, the entire mixing of powder and liquid has been accomplished efficiently with speed and accuracy without creating hazardous dust in the surrounding atmosphere.

To those skilled in the art to which this invention relates, many changes in construction and widely differing embodiments and applications of the invention will make themselves known without departing from the spirit and scope of the invention. The disclosure and the description herein are purely illustrative and are not intended to be in any sense limiting.

What is claimed is:

1. An apparatus for combining powdered and liquid constituents to form a slurry, comprising:

a first tank for initially holding a quantity of liquid;

a second tank having an upper and a lower end;

a motor driven agitator within said second tank;

a first conduit extending from said first tank into said second tank;

valve means in said first conduit;

control means responsive to the liquid level in said second tank for closing said valve means when the liquid in said second tank reaches a predetermined maximum level, said maximum level being in said lower end of said second tank at a level which is substantially lower than its full volumetric capacity so that an open chamber is formed in said upper end above said maximum liquid level;

an opening in the upper end of said second tank;

a vacuum pump having an inlet attached to said opening and an outlet attached to the upper end of said first tank;

a third conduit connected from the lower end of said second tank to said first tank and a pump in said third conduit; and powder conveying conduit means extending through said upper end of said second tank, said conveying conduit having a movable exterior section with an outer end opening and a fixed interior section within said second tank having an outlet extending slightly above said maximum liquid level; whereby a low pressure condition created within said open chamber above the maximum liquid level in said second tank causes an airstream in said conveying conduit which enables powdered material to be sucked into said second tank as mixing occurs with liquid therein to form a slurry.

2. The apparatus as described in claim 1 including agitator means in said first tank.

3. The apparatus as described in claim 1 wherein said agitator means in said second tank comprises a series of radially extending blades attached to the lower end of a shaft, and a motor for driving the shaft at its upper end outside of said second tank.

4. The apparatus as described in claim 1 wherein said outlet end of said fixed interior section of said powder conveying conduit means is located approximately four to six inches above the maximum level of mixed material in said second tank.

5. The apparatus as described in claim 1 wherein said control means for said valve means in said second tank comprises a float means, and linkage means connected between said float means and said valve means for shutting off said valve means when the mixed material in said second tank reaches a predetermined level.

* * * * *